US007219816B1

(12) United States Patent
Xia et al.

(10) Patent No.: US 7,219,816 B1
(45) Date of Patent: May 22, 2007

(54) EASILY SEALED AND OPENED PRE-FILLED, DISPOSABLE PIPETTE

(75) Inventors: Frank Zhishi Xia, Rancho Cucamonga, CA (US); Jack Yongfeng Zhang, Rancho Cucamonga, CA (US); Mary Zi-Ping Luo, Rancho Cucamonga, CA (US)

(73) Assignee: Amphastar Pharmaceuticals, Inc., Rancho Cucamonga, CA (US)

( * ) Notice: Subject to any disclaimer, the term of this patent is extended or adjusted under 35 U.S.C. 154(b) by 485 days.

(21) Appl. No.: 10/688,818

(22) Filed: Oct. 20, 2003

(51) Int. Cl.
*B65D 37/00* (2006.01)

(52) U.S. Cl. ..... 222/209; 222/215; 222/541.1; 222/541.9; 222/562; 222/633; 73/864.01; 422/100

(58) Field of Classification Search ..... 222/209–210, 222/213–215, 631–633, 107, 465.1, 541.9, 222/541.1, 153.06, 153.07, 562–563; 422/100; 73/864.01, 864.02, 864.11, 864.53
See application file for complete search history.

(56) References Cited

U.S. PATENT DOCUMENTS 3,785,366 A * 1/1974 Davis ..... 600/562
4,212,204 A * 7/1980 St. Amand ..... 73/864.11
4,779,768 A * 10/1988 St. Amand ..... 222/209
4,875,602 A * 10/1989 Chickering et al. ..... 222/187
5,125,544 A * 6/1992 Millner et al. ..... 222/215
5,261,881 A * 11/1993 Riner ..... 604/110
5,538,506 A * 7/1996 Farris et al. ..... 604/187
6,241,124 B1 * 6/2001 Hoyt ..... 222/143
6,357,626 B1 * 3/2002 Zhang et al. ..... 222/78
6,457,612 B1 * 10/2002 Zhang et al. ..... 222/465.1

* cited by examiner

*Primary Examiner*—Frederick C. Nicolas
(74) *Attorney, Agent, or Firm*—Albert O. Cota

(57) ABSTRACT

A pre-filled disposable pipette (10) consisting of a hollow bulb (12) dimensioned to enclose a medicinal product. From a lower end (16) of the bulb (12) is attached sequentially a medicinal transfer tube (24) and a medication fill tube (32), from where the medicinal product is applied. Between a lower end (28) of the tube (24) and an upper end (34) of the tube (32) is formed a break-away notch (40). When the tube (24) or the tube (32) is rotated, the notch (40) is twisted and breaks-off, thus allowing the medicinal product to flow from the bulb (12) and be released from the tube (24). The pipette (10) includes a primary grasping tab (46) attached to an upper end (14) of the bulb (12); a secondary grasping tab (54) attached to each side of the tube (24); and a support tab (70) attached to each side of the tube (32). The invention also discloses several methods for sealing the lower tip (36) of the medication fill tube (32).

7 Claims, 5 Drawing Sheets

EASILY SEALED AND OPENED PRE-FILLED, DISPOSABLE PIPETTE

TECHNICAL FIELD

The invention pertains to the general field of pipettes, and more particularly to an easily sealed and opened, pre-filled, disposable pipette that is filled with a medicinal product, used once and discarded.

BACKGROUND ART

A typical pipette consists of a slender pipe or tube that is used to transfer or measure small quantities of a liquid or a gas from one location to another. The most common type of pipette consists of a small plastic tube that widens into a bulb at the middle or the end.

Liquid may be sucked into the bulb and, retained therein by closing the top end of the pipette with a stopper, a person's thumb or the like. Most conventional prior art pipettes, if used as medication storage device, inherently have, the following problems:

1. Filling a pipette with liquid medication is difficult due to the pipette's narrow opening and the tendency of the bulb to deform if improperly handled, 2. After the pipette is filled any subsequent processing of the pipette is difficult, primarily because the bulb can be inadvertently deformed, thus causing the liquid therein to flow out. In general, conventional pipette designs do not include any grasping sections that allow pipettes to be conveniently handled. The bulb cannot be used as a grasping point because of its tendency to deform, and the remaining parts of a pipette are also not suitable for grasping because the mass center of a pre-filled pipette is centered on the bulb.

3. A conventional pre-filled pipette cannot be adequately sealed due to the handling problem described above.

4. Conventional sealing methods are not efficient as they require more materials and additional processes to accomplish the required seal.

5. Conventional sealing methods are also not reliable because the seal can be easily ruptured, causing product leakage.

6. Conventional means of opening the medicinal product contained within a pipette are not convenient and provide little protection for the patient.

The problem described in items 1, 2 and 3 have been addressed by the applicant's issued U.S. Pat. No. 6,457,612. The instant application provides a solution to the problems described in items 4, 5 and 6.

A search of the prior art did not disclose any literature or patents that read directly on the claims of the instant invention. However, the following U.S. patents are considered related:

| PATENT NO. | INVENTOR | ISSUED |
|---|---|---|
| 6,457,612 | Zhang, et al | 1 Oct. 2002 |
| 5,073,347 | Garren, et al | 17 Dec. 1991 |
| 4,875,602 | Chickering, et al | 24 Oct. 1989 |
| 4,563,104 | Saint-Amand | 7 Jan. 1986 |
| 4,483,825 | Fatches | 20 Nov. 1984 |

U.S. Pat. No. 6,457,612 discloses a pre-filled disposable pipette consisting of a hollow bulb dimensioned to enclose a medicinal product and having attached a medication transfer tube from where the pipette is filled and medicinal product released. The pipette has a primary grasping tab attached to an upper end of the bulb, a secondary grasping tab attached to each side of the tube, and a support tab also attached to each side of the tube near the lower end of the tube. The pipette can be automatically filled and sealed by a cap or heat applied foil.

U.S. Pat. No. 5,073,347 discloses a volumetric pipette for dispensing liquids. The pipette is formed as a unitary structure made of components which are bonded together to create a precision fluid dispensing device. The pipette includes a stem portion, which is separately formed and is bonded to a bulb portion to complete the pipette.

U.S. Pat. No. 4,875,602 discloses a liquid dispensing apparatus which includes a self-contained source of fluid that is normally isolated within a reservoir bulb. The bulb is deformed to initially rupture a membrane, thereby allowing the fluid to be forced through a shaft bore to saturate a tip-mounted swab. Alternatively, the membrane may be positioned intermediate two aligned sections of the shaft and is ruptured upon partial axial collapse of the sections.

U.S. Pat. No. 4,563,104 discloses a disposable liquid dispensing pipette which delivers an accurate and uniform drop of liquid of a given size and which incorporates an integral paddle stirrer. The device includes a dispensing tube that is connected to a flexible and resilient bulb and paddle stirrer. The open end of the tube can be made in various sizes to accommodate different drop sizes.

U.S. Pat. No. 4,483,825 discloses a pipette having a liquid receiving hollow generally encompassed by deformable sidewalls. The pipette further has a tapered liquid outlet extending from one end of the hollow, and a liquid inlet on the other end of the hollow, within which is located a semi-permeable filter.

For background purposes and as indicative of the art to which the invention is related reference may be made to the remaining cited patents.

| PATENT NO. | INVENTOR | ISSUED |
|---|---|---|
| 6,117,394 | Smith | September 2000 |
| 5,927,884 | Kao | July 1999 |
| 5,702,035 | Tsao | December 1997 |
| 4,779,768 | St. Amand | October 1988 |
| 3,951,313 | Coniglione | April 1976 |
| 3,792,699 | Tobin | February 1974 |
| 3,495,917 | Truhan | February 1970 |

DISCLOSURE OF THE INVENTION

The pre-filled disposable pipette disclosed herein features a simple structure for breaking the seal of a pipette, and several methods for sealing a pipette that contains a medicinal or other products which can have a consistency ranging from a liquid to a paste. In its most basic form, the inventive pipette is comprised of:

a) a hollow bulb containing a medicinal product and having an upper end, and a lower end that further has a substantially centered opening, b) a medication transfer tube having an upper end that interfaces with the centered opening on the hollow bulb, and a lower end, c) a medication fill tube having an upper end and a lower tip, d) a break-away notch located between the lower end of the medication transfer tube and the upper end of the medication fill tube. When the area encompassing the notch is twisted, the medication fill tube breaks away from the medication transfer tube, thus allowing the medicinal product in the hollow bulb to be dispensed from the lower end of medication fill tube, and e) means for sealing the lower tip of the medication fill tube.

A conventional prior art, pre-filled disposable pipette typically consists of a hollow bulb having an upper end, a lower end and is dimensioned to enclose a medicinal product. From the lower end of the bulb extends outward a medication transfer tube, from where the pipette is filled and a medicinal product released. The pipette includes a primary grasping tab attached to the upper end of the bulb, a secondary grasping tab attached to each side of the medicinal transfer tube, and a support tab also attached to each side of the tube near the lower end of the tube. The pipette is typically sealed by means of either a cap or heat-applied foil. The filled prior art pipette is not easily and efficiently sealed in terms of the manufacturing process and cost because additional material such as foil is required, as well as additional equipment and steps to cut and shape the foil to provide means for opening the medicinal product contained within the pipette. The pipette's seal is also not reliable, as it can be easily ruptured, thereby causing leakage of the medicinal product. Furthermore, the seal cannot be expediently opened since the means for removing the foil cover can be easily cleaved.

The inventive easily sealed and opened, pre-filled, disposable pipette provides an improvement over prior art design by adding a break-away notch between the support tab and the secondary grasping tab. By twisting the support tab with respect to the secondary grasping tab, the support tab can be easily and cleanly removed around the area encompassing the break-away notch.

Another improvement of the easily sealed and opened, pre-filled, disposable pipette is the sealing method. The open end of the pipette is sealed by applying sufficient heat to melt the pipette tip, then using a mechanical means to perfect the seal.

In view of the above disclosure, the primary object of the invention is to produce an easily manipulated pipette that can be easily and expediently sealed and opened.

Another object of the invention is to produce a pipette with an opening means that provides dexterity and protection for the patient.

Still another object of the invention is to produce a pipette that can have a reliable seal, thus reducing the possibility of medicinal product leakage.

Yet another object of the invention is to produce a pipette that can be readily and conveniently handled and maneuvered, to be automatically filled and to accommodate the pipette sealing methods.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for an easily sealed and opened, pre-filled disposable pipette 10 (hereinafter "pipette 10"). The pipette 10 is designed to contain and release a medicinal product selected from a group consisting but not limited to a liquid, an aqueous solution, an oil, a solvent, an emulsion, a cream, an ointment, a lotion, a paste, a jelly and a balm.

Figure 1:
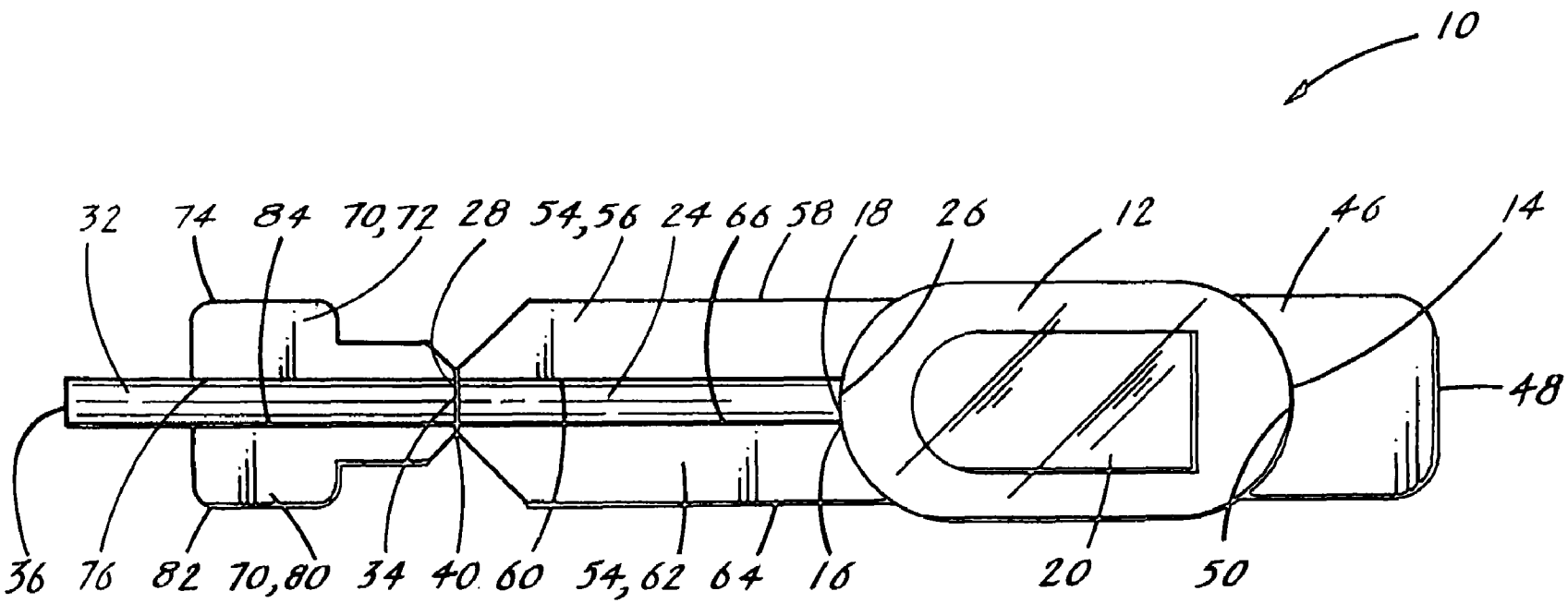
FIG. 1 is a side elevational view of the pre-filled disposable pipette showing the relative locations of the elements that comprise the pipette.
Figure 2:
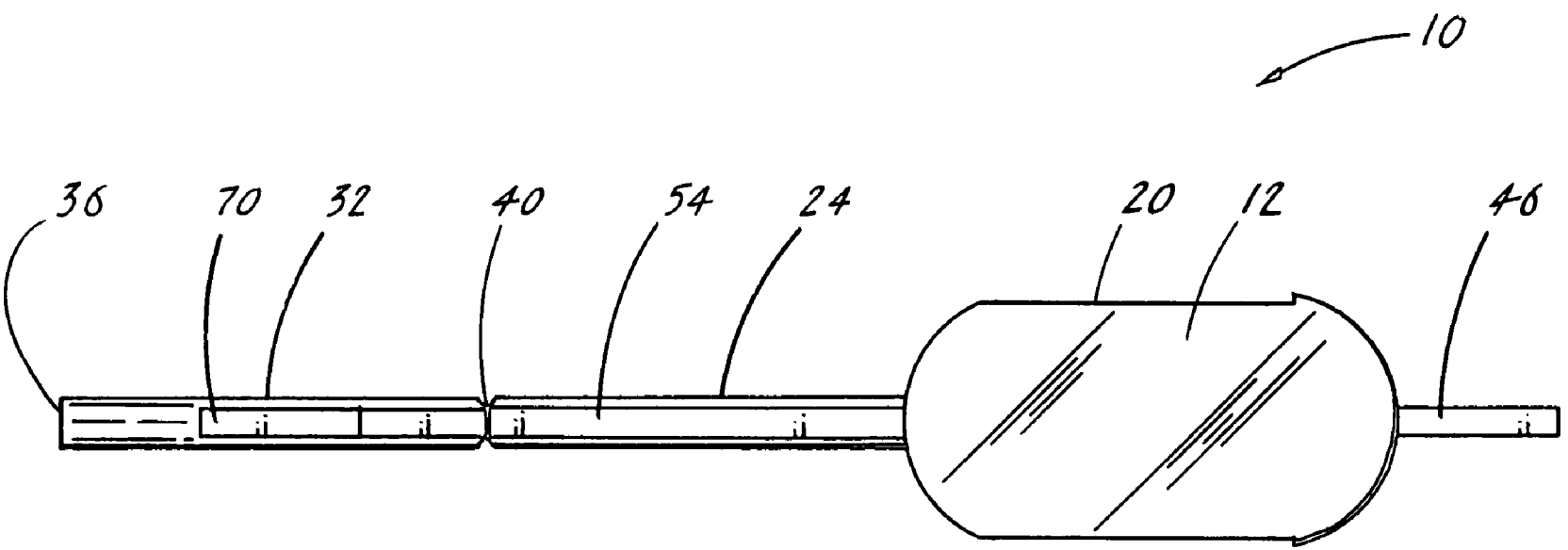
FIG. 2 is a top plan view of the pre-filled disposable pipette.
Figure 3:
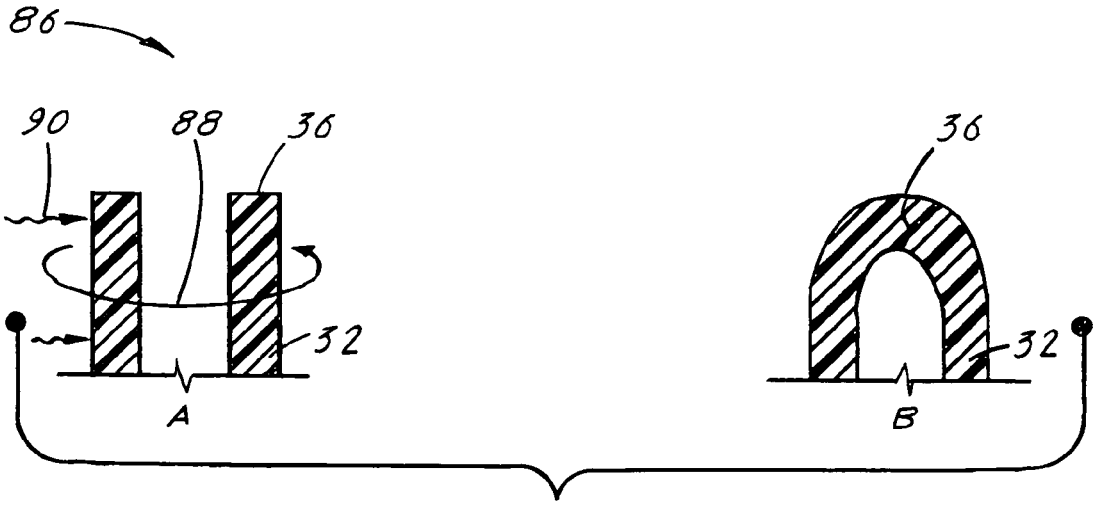
FIG. 3 is a partial elevational and cross-sectional view of a lower tip sealing means that utilizes a heat flow across the lower tip of a rotating pipette to melt and seal the open end due to the surface tension caused by the heat.
Figure 4:
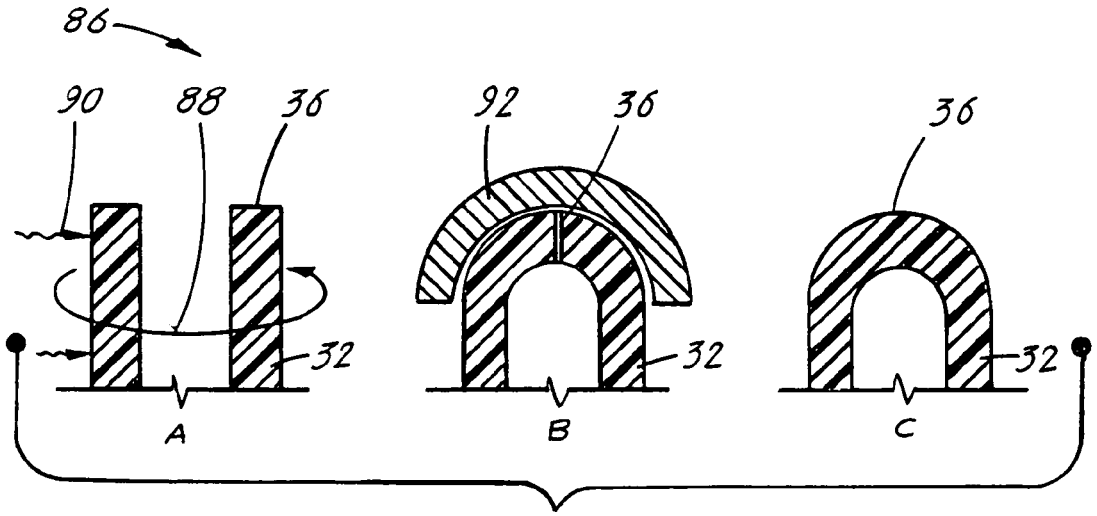
FIG. 4 is a partial elevational and cross-sectional view of a lower tip sealing means that utilizes heat flow across the lower tip of a rotating pipette to melt the tip and thereafter using an ambient temperature device to crimp the melted tip and seal the lower tip.
Figure 5:
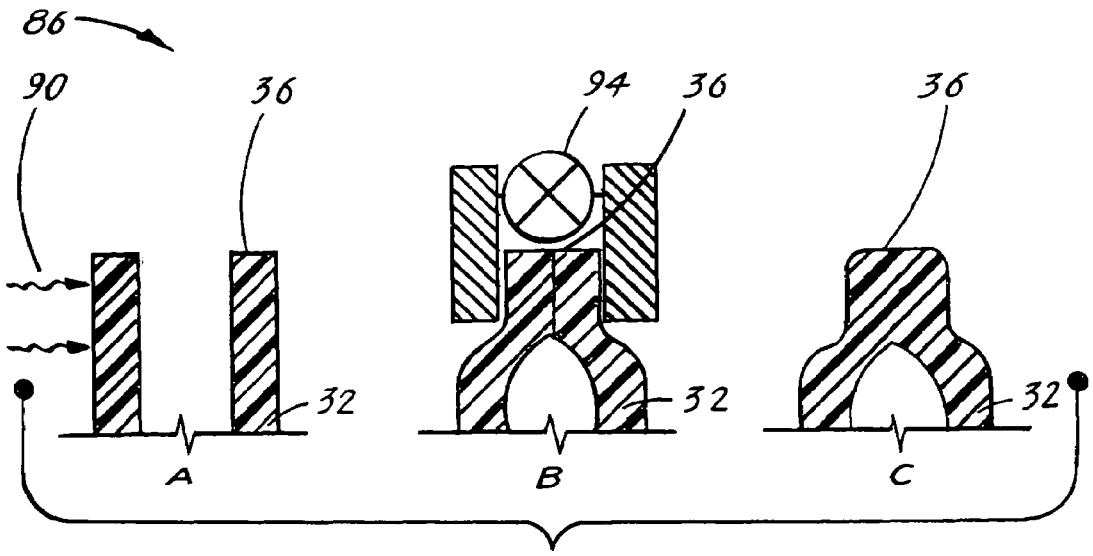
FIG. 5 is a partial elevational and cross-sectional view of a lower tip sealing means that utilizes heat flow across the sides of the lower tip of the pipette to melt the tip and thereafter using an ambient temperature clamp to crimp the two sides of the melted tip and seal the lower tip.
Figure 6:
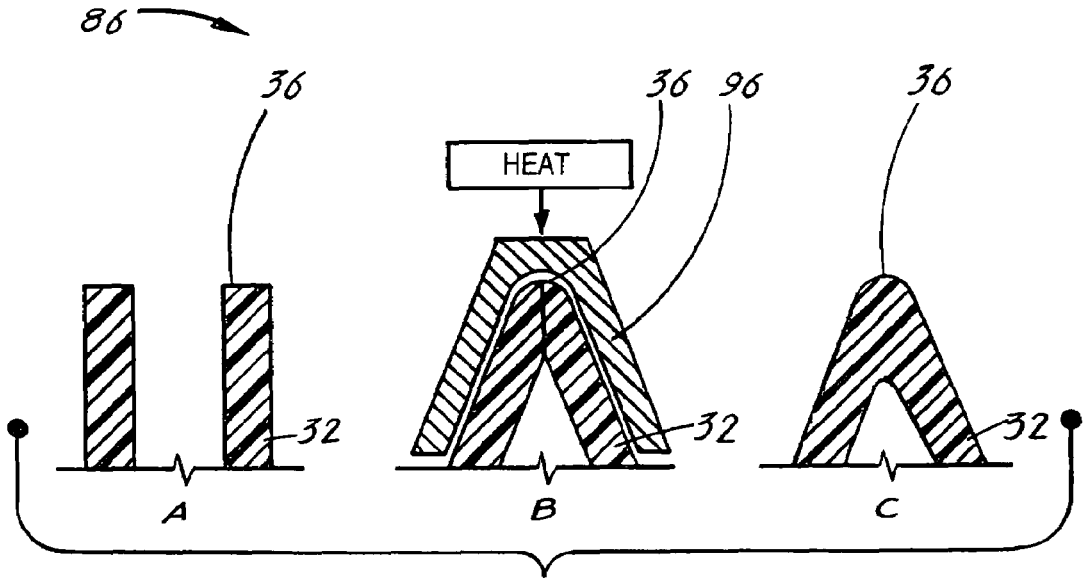
FIG. 6 is a partial elevational and cross-sectional view of a lower tip sealing means that utilizes a heated element to melt and seal the lower tip.
Figure 7:
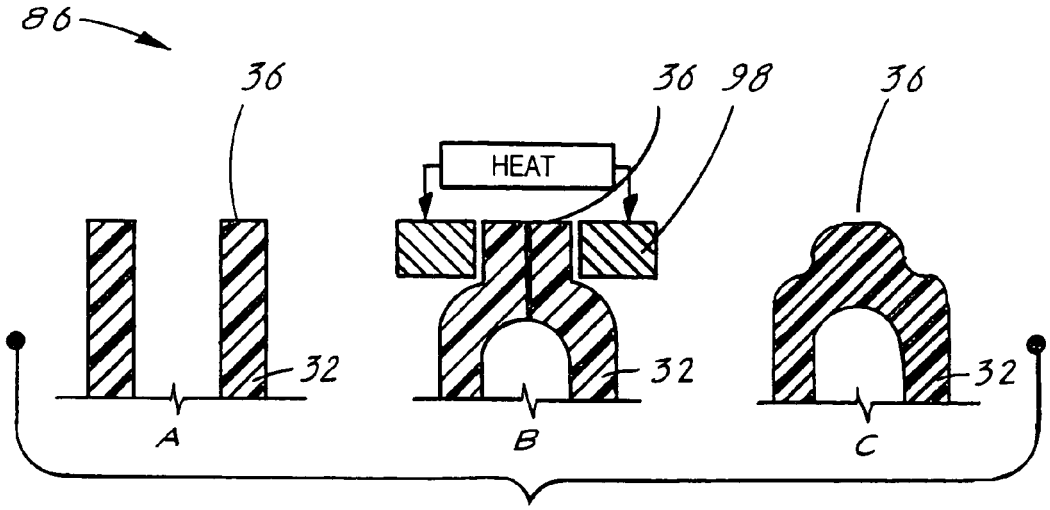
FIG. 7 is a partial elevational and cross-sectional view of a lower tip sealing means that utilizes a high-temperature, dual-element device that melts, crimps and seals the lower tip.
Figure 8:
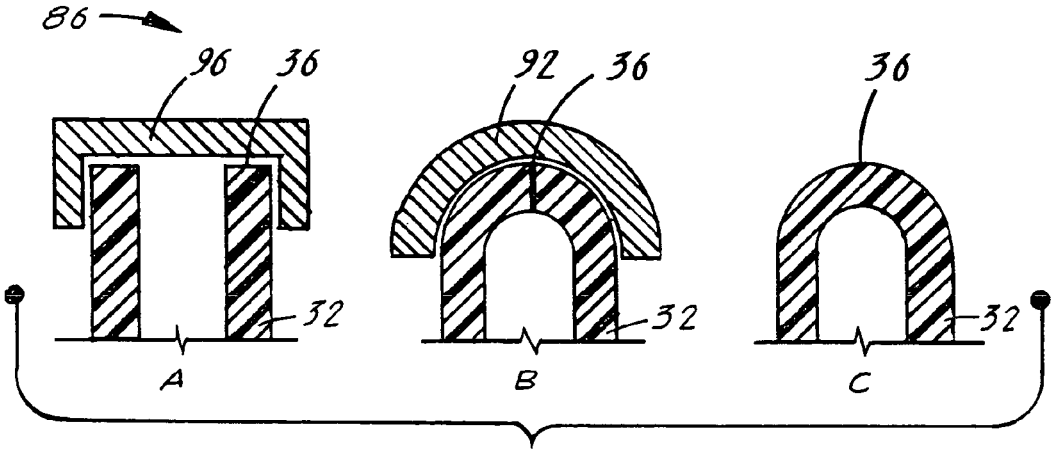
FIG. 8 is a partial elevational and cross-sectional view of a lower tip end sealing means that utilizes a heated element to melt the lower tip of the pipette and thereafter using an ambient-temperature device to crimp, shape and seal the lower tip.
Figure 9:
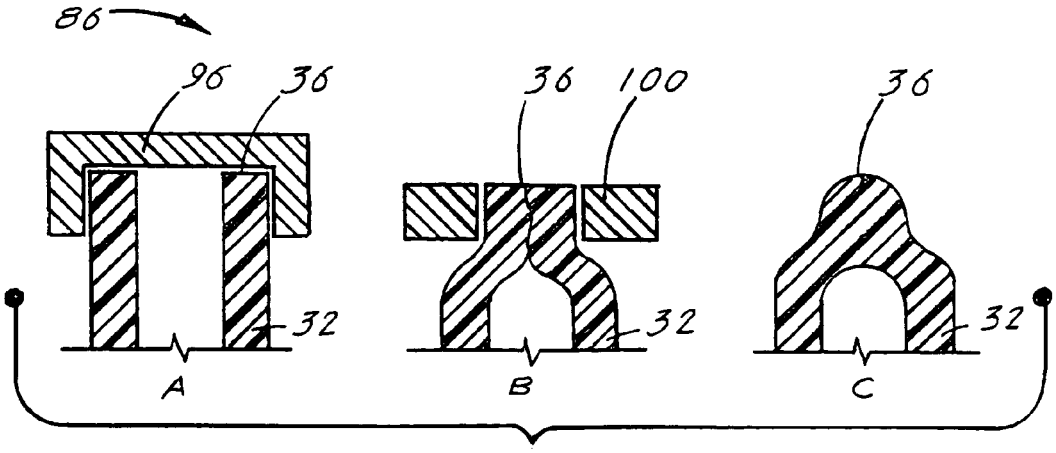
FIG. 9 is a partial elevational and cross-sectional view of a lower tip sealing means that utilizes a heated element to melt the lower tip of the pipette and thereafter using an ambient-temperature, dual-element device to crimp and seal the lower tip.

As shown in FIGS. 1 and 2, the pipette 10 is comprised of several major elements. A hollow bulb 12 that has an upper end 14 and a lower end 16, which further has a substantially centered opening 18. The preferred cross section of the hollow bulb is round, however other shapes can also be used. A medication transfer tube 24 that has an upper end 26 and a lower end 28, with the upper end 26 interfacing with the centered opening 18 on the hollow bulb 12. The internal diameter of the transfer tube 24 is at least two times smaller than the internal diameter of the hollow bulb 12. A medication fill tube 32 that has an upper end 34 and a lower tip 36. A break-away notch 40 that is located between the lower end 28 of the medication transfer tube 24 and the upper end 34 of the medication fill tube 32. The break-away notch 40 when twisted, causes the medication fill tube 32 to break off from the medication transfer tube 24, thus allowing the medication located within the hollow bulb 12 to be released from the lower end 28 of the medication transfer tube 24. The final major element of the pipette 10 is a means 86 for sealing the lower tip 36 of the medication fill tube 32, as shown in FIGS. 3–9.

The pipette 10, as shown in FIGS. 1 and 2, further comprises a primary grasping tab 46. The tab 46 is shaped and dimensioned to allow the tab to be easily grasped by two fingers, thus permitting the pipette 10 to be carried or held without contacting the sensitive hollow bulb 12 which is filled with the medicinal product.

The tab 46 has an upper edge 48 and a lower edge 50, which centrally interfaces with and conforms to the upper end 14 of the hollow bulb 12. As also shown in FIGS. 1 and 2, the pipette further comprises a secondary grasping tab 54 having a first section 56 and a second section 62, and a support tab 70 having a first section 72 and a second section 80. The first section 56 of the secondary grasping tab 54 has an outer edge 58 and an inner edge 60, which interfaces with a first side of the medication transfer tube 24. The second section 62 of the tab 54 has an outer edge 64 and an inner edge 66, which interfaces with a second side of the medication transfer tube 24. The first section 72 of the support tab 70 has an outer edge 74 and an inner edge 76, which interfaces with a first side of the medication fill tube 32. The second section 80 of the support tab 70 has an outer edge 82 and an inner edge 84, which interfaces with a second side of the medication fill tube 32.

As shown in FIG. 1, the pipette 10 can further include a flat finger-grasping area 20 that is located on opposite sides of the hollow bulb 12. The flat area 20 allows the pipette 10 to be conveniently held when dispensing the medicinal product.

The hollow bulb 12, the medication transfer tube 24, the medication fill tube 32, the break-away notch 40, the primary grasping tab 46, the secondary grasping tab 54 and the support tab 70 are all integrally molded of a thermoplastic. The type of thermoplastic is selected from a group consisting of: polycarbonate, polyethylene, polyester, polystyrene, polypropylene, polysulfone, polyurethane and ethylene-vinyl-acetate. Additionally, the thermoplastic can be transparent or color tinted to indicate the type or the quantity of medication located within the hollow bulb 12.

As shown in FIGS. 3–9, several means 86 are disclosed by which the lower tip 36 of the medication fill tube 32 can be sealed.

The first means for sealing the medication fill tube's lower tip 36 is comprised of applying a heat flow 90 to the lower tip 36, which is being rotated by a tip rotating means 88 to melt the tip, as shown in FIG. 3A. The surface tension caused by the melted tip then seals the tip 36, as shown in FIG. 3B.

The second means for sealing the medication fill tube's lower tip 36 is comprised of applying a heat flow 90 to the lower tip 36, which is being rotated by a tip rotating means 88, to melt the tip, as shown in FIG. 4A. An ambient temperature device 92 having an opening is subsequently pressed over the melted tip to seal the tip 36, as shown in FIG. 4B, to produce a sealed tip 36, as shown in FIG. 4C.

The third means for sealing the medication fill tube's lower tip 36 is comprised of applying a heat flow 90 to the lower tip 36 to melt the tip, as shown in FIG. 5A. An ambient temperature clamp 94, as shown in FIG. 5B, is then adjusted to clamp the melted tip and seal the tip 36, as shown in FIG. 5C.

The fourth means for sealing the medication fill tube's lower tip 36 is comprised of inserting over an ambient temperature lower tip 36, as shown in FIG. 6A, a heated element 96, as shown in FIG. 6B, that melts and crimps the tip. After the heated element 96 is removed, a sealed tip 36 is produced, as shown in FIG. 6C.

The fifth means of sealing the medication fill tube's lower tip 36 is comprised of applying to an ambient temperature lower tip, as shown in FIG. 7A, a high-temperature, dual-element device 98, as shown in FIG. 7B, that melts and crimps the lower tip 36 to produce a sealed lower tip 36, as shown in FIG. 7C.

The sixth means for sealing the medication fill tube's lower tip 36 is comprised of placing a heated element 96 over the lower tip 36 to melt the tip, as shown in FIG. 8A. An ambient temperature device 92, as shown in FIG. 8B, is then placed over the melted lower tip 36 that crimps and seals the lower tip 36 to produce a sealed lower tip 36, as shown in FIG. 8C.

The seventh and final means for sealing the medication fill tube's lower tip 36 utilizes a heated element 96 that is placed over the lower tip 36, as shown in FIG. 9A, to melt the lower tip. Thereafter, an ambient-temperature, dual-element device 100, as shown in FIG. 9B, is placed over the melted tip 36 that crimps and seals the lower tip 36 to produce a sealed lower tip 36, as shown in FIG. 9C.

While the invention has been described in complete detail and pictorially shown in the accompanying drawings it is not to be limited to such details, since many changes and modifications may be made to the invention without departing from the spirit and the scope thereof. For example, the pre-filled disposable pipette 10 can be made in various sizes to accommodate various quantities and consistencies of medicinal and similar products. Also, while several means for sealing the lower tip 36 of the medication fill tube 32 have been disclosed, other sealing means can be utilized with equal effectiveness. Additionally, the ambient temperature device 92 and the heated element 96 can be designed to produce various geometric sealing shapes. Hence, it is described to cover any and all modifications and forms, which may come within the language and scope of the claims.

The invention claimed is:

1. A pre-filled disposable pipette comprising:

a) a hollow bulb containing a medicinal product and having an upper end and a lower end further having a substantially centered opening, b) a primary grasping tab having an upper edge and a lower edge that centrally interfaces with and conforms to the upper end of said hollow bulb, c) a medication transfer tube having an upper end that interfaces with the centered opening on said hollow bulb, and a lower end, d) a medication fill tube having an upper end and a lower tip, e) a break-away notch located between the lower end of said medication transfer tube and the upper end of said medication fill tube, wherein when said notch is caused to be twisted, the medication fill tube breaks off from said medication transfer tube, allowing the medicinal product in said hollow bulb to be dispensed from the lower end of said medication transfer tube, and f) means for sealing the lower tip of said medication fill tube, wherein said lower tip sealing means is comprised of a fourth lower tip sealing means comprising inserting over an ambient temperature lower tip, a heated element that melts and crimps the lower tip, wherein after the heated element is removed a sealed lower tip is produced.

2. The pre-filled disposable pipette as specified in claim 1 further comprising a secondary grasping tab comprising:

a) a first section having an outer edge and an inner edge that interfaces with a first side of said medication transfer tube, and b) a second section having an outer edge and an inner edge that interfaces with a second side of said medication transfer tube.

3. The pre-filled disposable pipette as specified in claim 2 further comprising a support tab comprising:

a) a first section having an outer edge and an inner edge that interfaces with a first side of said medication fill tube, and b) a second section having an outer edge and an inner edge that interfaces with a second side of said medication fill tube.

4. The pre-filled disposable pipette as specified in claim 1 wherein said hollow bulb further comprises on two opposite sides a flat finger-grasping area.

5. The pre-filled disposable pipette as specified in claim 1 wherein said hollow bulb, said medication transfer tube, said medication fill tube, said break-away notch, said primary grasping tab, said secondary grasping tab and said support tab are all integrally molded of thermoplastic.

6. The pre-filled disposable pipette as specified in claim 5 wherein said thermoplastic can be transparent or color tinted to indicate the type or the quantity of medication located in said hollow bulb.

7. A pre-filled disposable pipette comprising:

a) a hollow bulb containing a medicinal product and having an upper end and a lower end further having a substantially centered opening, b) a medication transfer tube having an upper end that interfaces with the centered opening on said hollow bulb, and a lower end, c) a medication fill tube having an upper end and a lower tip, d) a break-away notch located between the lower end of said medication transfer tube and the upper end of said medication fill tube, wherein when said notch is caused to be twisted, the medication fill tube breaks off from said medication transfer tube, allowing the medicinal product in said hollow bulb to be dispensed from the lower end of said medication transfer tube, and e) means for sealing the lower tip of said medication fill tube, wherein said lower tip sealing means is comprised of a fourth lower tip sealing means comprising inserting over an ambient temperature lower tip, a heated element that melts and crimps the lower tip, wherein after the heated element is removed a sealed lower tip is produced.

* * * * *